US006601730B2

(12) United States Patent
Chen

(10) Patent No.: US 6,601,730 B2
(45) Date of Patent: Aug. 5, 2003

(54) WET TOWEL DISPENSING APPARATUS

(75) Inventor: Chien-Jung Chen, Kaohsiung (TW)

(73) Assignee: Yen Sun Technology Corp., Kaohsiung Hsien (TW)

( * ) Notice: Subject to any disclaimer, the term of this patent is extended or adjusted under 35 U.S.C. 154(b) by 107 days.

(21) Appl. No.: 09/835,553

(22) Filed: Apr. 17, 2001

(65) Prior Publication Data

US 2002/0148848 A1 Oct. 17, 2002

(51) Int. Cl.[7] ..... B65H 5/28
(52) U.S. Cl. ..... 221/71; 221/25; 221/70
(58) Field of Search ..... 221/71, 70, 25

(56) References Cited

U.S. PATENT DOCUMENTS 2,885,071 A * 5/1959 Rodnon ..... 206/258
3,107,782 A * 10/1963 Jaroff et al. ..... 206/362
3,288,327 A * 11/1966 Cahlik ..... 221/70
3,306,494 A * 2/1967 Castner ..... 221/81
3,310,199 A * 3/1967 Roberts et al. ..... 221/25
5,065,894 A * 11/1991 Garland ..... 221/25
5,860,561 A * 1/1999 Saldana et al. ..... 221/25
6,213,343 B1 * 4/2001 Damikolas ..... 221/25

FOREIGN PATENT DOCUMENTS

TW 356819 10/1997

* cited by examiner

*Primary Examiner*—Donald P. Walsh
*Assistant Examiner*—Jonathan R. Miller
(74) *Attorney, Agent, or Firm*—Birch, Stewart, Kolasch & Birch LLP

(57) ABSTRACT

The present invention is to make a towel material for forming a wet towel, that is made by a drying, compressing or evacuating manner into compact units having a winding bar shape, or block shape. The units are connected by connecting members into a strap, so that the towel material strap may be stored in the chamber of the dispensing apparatus. After the user emits the using signal, the towel material strap is serially drawn out by a control wheel member, and the connecting member is wound by the winding roller, so that the units may fall into the output member or the article outlet. The units are wet or immersed in the liquid, so that the units may be expanded into a wet towel.

6 Claims, 5 Drawing Sheets

WET TOWEL DISPENSING APPARATUS

BACKGROUND OF THE INVENTION

1. Field of the Invention

The present invention relates to a wet towel dispensing apparatus, wherein the towel material of the wet towel may be maintained at a smaller volume, and the wet towel can be made conveniently.

2. Description of the Related Art

The closest prior art of which the applicant is aware is disclosed in the Taiwanese Patent Publication No. 356819, entitled by "Cutting Structure Improvement of a Wet Paper Towel Supplying Machine", wherein it discloses a cutting structure of a wet paper towel. A U-shaped frame is mounted in a machine station for placing a paper towel material wheel, so that the paper towel material is transferred by the driving wheel to enter the guide plate set, the mobile cutting blade shaft, and the lower cutting blade set to be cut into a predetermined length to proceed the twisting work. The two ends of the main shaft of the mobile cutting blade shaft are respectively secured with a push cam and a press cam. The push cam is protruded with a push section, and the press cam is recessed with an operation section. The press plate of the guide plate set and the lower cutting blade set are provided with an elasticity by elastic members. Thus, the lower cutting blade set is initially pressed to the inner side by the press cam. When the paper towel material is to be cut, the press cam is rotated to the operation section, so that the lower cutting blade set moves back by the elastic force of the elastic member, to mate with the upper cutting blade of the mobile cutting blade set, while the press plate is pressed by the push plate of the push cam whereby the lower end of the press plate is closely rested on the guide plate to clamp the paper towel material, so that the upper and lower cutting blades may cut the paper towel material conveniently.

In the conventional manufacturing method of a wet towel, an entire roll of paper towel material is stored, then cut by the upper and lower cutting blades, and is then processed by wetting and twisting works, so that the dry paper towel is formed into a wet paper towel to be output. In general, the conventional manufacturing method of the wet towel has a complicated construction, and the cutting blades and the twisting equipment cannot endure use during a long period of time, so that they are easily worn out. In addition, the entire roll of paper towel material is stored, so that the diameter of the paper towel material is enlarged to satisfy the requirement of use of a large amount. Thus, the volume of the paper towel machine becomes very large relatively.

SUMMARY OF INVENTION

The primary objective of the present invention is to provide a towel material strap of a wet towel, wherein the units of a smaller volume may be formed, and the units may be sent out continuously, to be wet by the ejected liquid or immersed in the liquid to absorb the liquid, so that the units are expanded into wet towel.

A secondary objective of the present invention is to provide a dispensing apparatus of a wet towel, wherein the dispensing apparatus of the wet towel has a simple structure, can be used during a long period of time, and is not easily worn out.

The present invention is to make a towel material for forming a wet towel, that is made by a drying, compressing or evacuating manner into compact units having a winding bar shape, or block shape. The units are connected by connecting members into a strap, so that the towel material strap may be stored in the chamber of the dispensing apparatus. After the user emits the using signal, the towel material strap is serially drawn out by a control wheel member, and the connecting member is wound by the winding roller, so that the units may fall into the output member or the article output. The units are wet or immersed in the liquid, so that the units may be expanded into a wet towel.

Further benefits and advantages of the present invention will become apparent after a careful reading of the detailed description with appropriate reference to the accompanying drawings.

BRIEF DESCRIPTIONS OF THE DRAWINGS

DETAILED DESCRIPTION OF THE PREFERRED EMBODIMENTS

Figure 2:
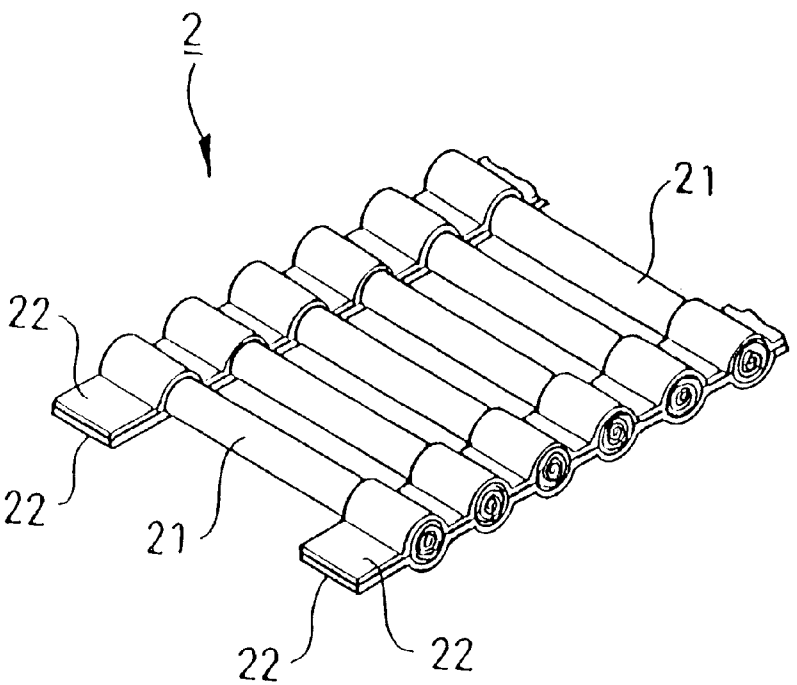
FIG. 2 is a perspective view of a towel material strap in accordance with a second embodiment of the present invention.
Figure 1:
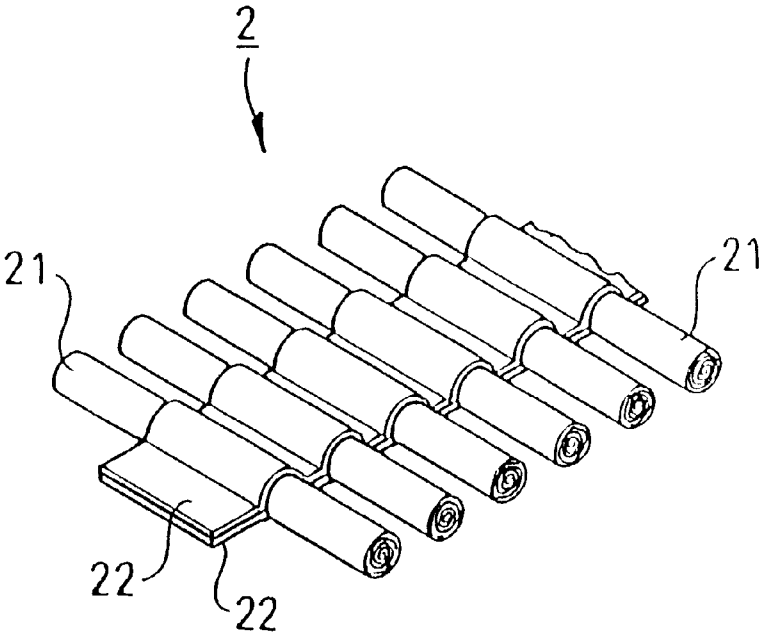
FIG. 1 is a perspective view of a towel material strap in accordance with a first embodiment of the present invention.

Referring to the drawings and initially to FIG. 1, a towel material strap 2 in accordance with a first preferred embodiment of the present invention may be derived from cotton starch, wood starch etc. made of a natural fiber or synthetic fiber, and may be made into units 21 which have a smaller compact volume by a drying, compressing or evacuating manner. The units 21 may be formed with a bar shape or a block shape, and the top and bottom sides of the units 21 are fixed by the connecting members 22, thereby forming the towel material strap 2. The connecting members 22 may be bonded on the middle of the units 21 as shown in FIG. 1, or bonded on the two sides of the units 21 as shown in FIG. 2. The towel material strap 2 may be placed in the chamber 11 of the housing 1, and may be taken out serially.

Figure 3:
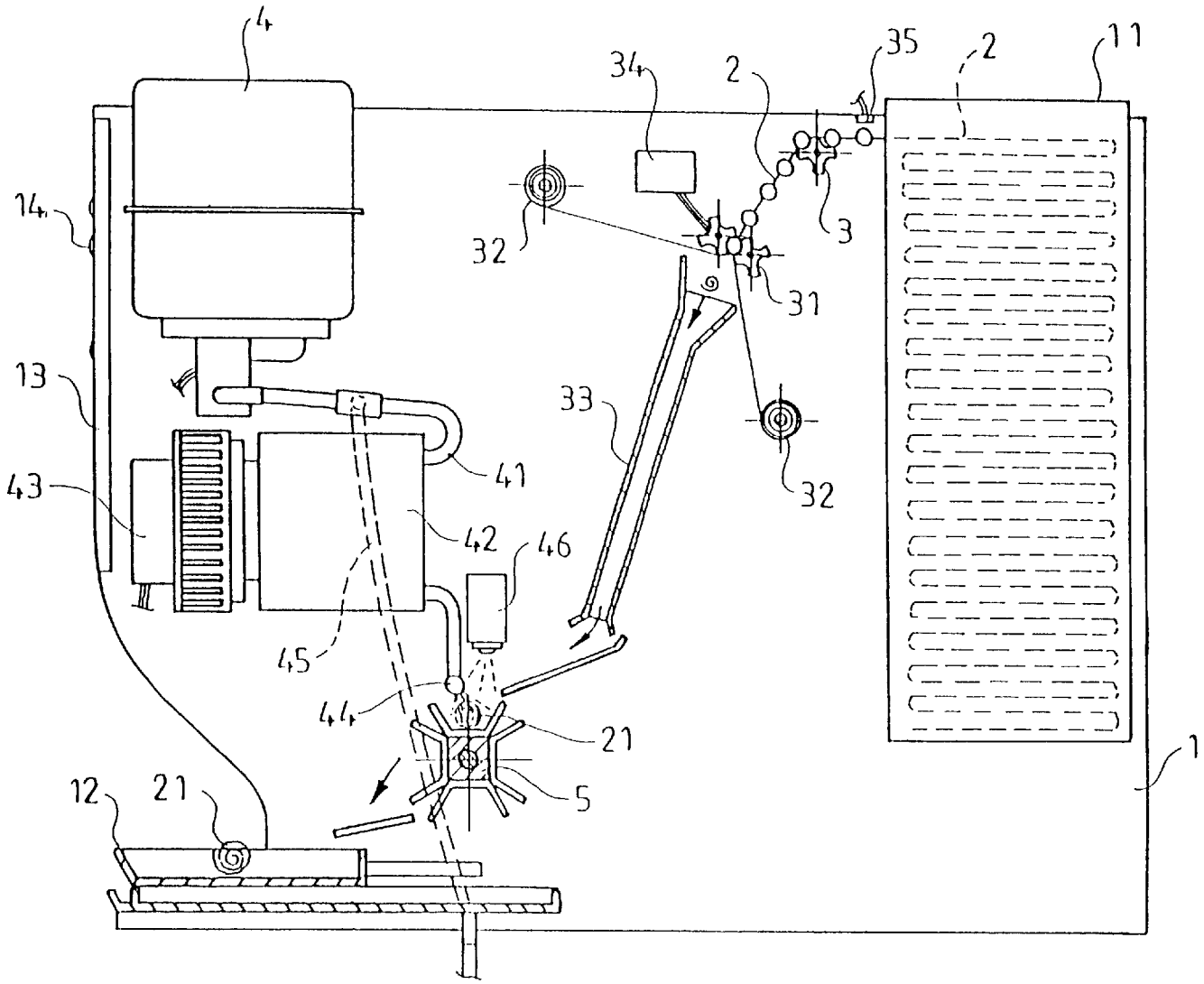
FIG. 3 is a schematic view of a dispensing apparatus of a wet towel in accordance with a first embodiment of the present invention.

Referring now to FIG. 3, the wet towel dispensing apparatus in accordance with the first preferred embodiment of the present invention comprises a housing 1 that may be placed or suspended at a proper position. The housing 1 has a chamber 11 for storing the towel material strap 2, and one end of the towel material strap 2 can be serially taken out from the chamber 11. The housing 1 is provided with a panel 13, and a control member 14, such that the dispensing apparatus of the wet towel may be manipulated, and such that the wet towel can be used from the article outlet 12. In the preferred embodiment, the push buttons of the control member 14 may be pressed to select the amount of the using wet towel, and to select the hot wet towel or cold wet towel.

The control wheel member 3 may be a wheel that can be driven. The user may push the control member 14 to send a using signal, whereby the control wheel member 3 can be driven to rotate by a power member, such as a motor, so that the units 21 of the towel material strap 2 can be serially drawn outward by the control wheel member 3. The towel material strap 2 drawn outward by the control wheel member 3 is controlled by the roll 31, and the connecting members 22 are restored by a winding roller 32. The units 21 that have been stripped may be introduced through the guide conduit 33 to the output member 5. The output amount of the units 21 may be calculated by the sensor 34. When the entire towel material strap 2 is completely released, the sensor 35 may emit a signal, so as to supply the towel material strap 2 into the chamber 11 in time.

The liquid supply member 4 may be mounted at a proper position of the housing 1, for storing a liquid with a normal temperature. When the user sends the signal of using the hot wet towel or cold wet towel, the liquid may be guided through the guide pipe 41 to the heating member 42 or the cooling member 43, wherein the heating member 42 may be a conventional electrical heater, and the cooling member 43 may be a conventional cooling chip or refrigerant compressor. Thus, the liquid may be formed into the hot water or cold water, and may be ejected through a plurality of nozzles 44, so as to wet the units 21 placed in the output member 5, so that the units 21 are expanded to form the hot wet towel or cold wet towel. In addition, the liquid supply member 4 may be provided with a liquid drain pipe 45. When the liquid stored in the liquid supply member 4 needs to be cleaned or drained, the liquid may directly drained outward through the liquid drain pipe 45. In addition, during the wetting process of the units 21, the auxiliary nozzle 46 may eject a fragrant agent, so that the hot wet towel or cold wet towel contains fragrance.

The output member 5 is located at the terminal of the guide conduit 33, to mate with the liquid ejecting position of the nozzle 44, and may be formed with a plurality of receiving slots that are rotated like a wheel. The operation of the output member 5 may be controlled by a program or a timer. After the units 21 fall and are wet, the output member 5 may be driven by a power member to rotate through a proper angle, so that the hot wet towel or cold wet towel may fall into an article outlet 12 mounted on the housing 1 to be used. The amount of rotation of the output member 5 may be calculated by a sensor.

Referring to FIG. 3, in use of the wet towel dispensing apparatus in accordance with the present invention, the towel material strap 2 is placed in the chamber 11 of the housing 1, so that one end of the towel material strap 2 placed in the chamber 11 of the housing 1 is serially drawn out by the control wheel member 3. The user may push the control member 14 to emit a using signal, so that the control wheel member 3 may be rotated through a proper angle. A predetermined amount of units 21 may be calculated by the sensor 34 and may fall through the guide conduit 33 to the output member 5. At this time, the liquid supply member 4 outputs the liquid which is controlled by the using signal emitted from the user to flow through the operated heating member 42 or cooling member 43, 50 that the liquid becomes hot water or cold water, to wet the units 21 placed in the output member 5. After the unit 21 absorbs the liquid, the unit 21 may be expanded into a wet towel during a short period of time (about three seconds), which may be driven by the output member 5 to fall into the article outlet 12 for use.

Figure 4:
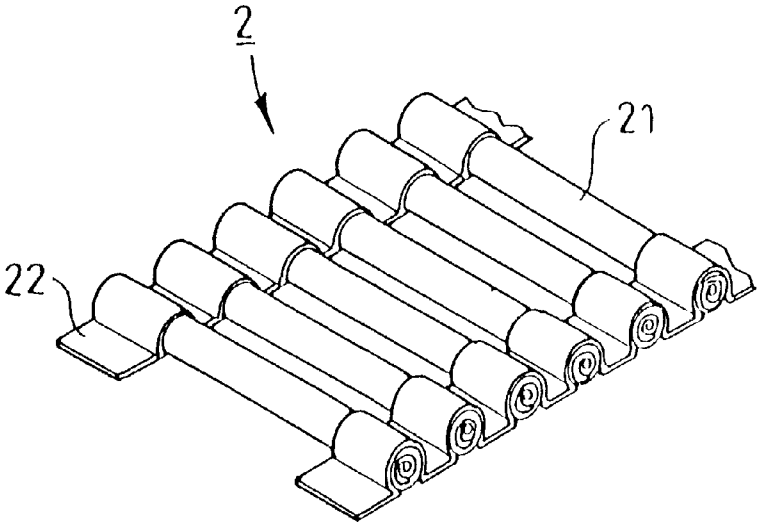
FIG. 4 is a perspective view of a towel material strap in accordance with a third embodiment of the present invention.

Referring to FIG. 4, a towel material strap 2 in accordance with a third preferred embodiment of the present invention may be derived from cotton starch, wood starch etc. made of a natural fiber or synthetic fiber, and may be made into units 21 which have a smaller compact volume by a drying, compressing or evacuating manner. The units 21 may be formed with a rolled bar shape or a block shape, and the units 21 are fixed by connecting members 22, thereby forming the towel material strap 2. The connecting member 22 may be a strap coated with adhesive, or a plastic film, so that the units 21 are equally spaced. In addition, the connecting members 22 may be bonded on the middle of the units 21, or bonded on the two sides of the units 21.

Figure 5:
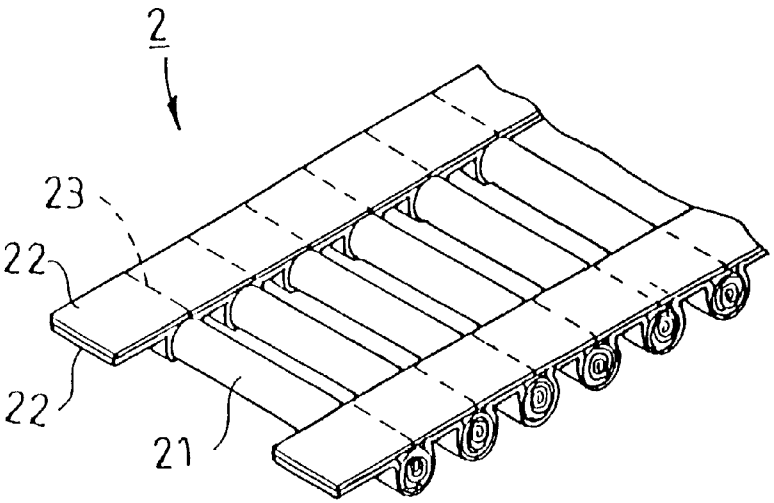
FIG. 5 is a perspective view of a towel material strap in accordance with a fourth embodiment of the present invention.

Referring to FIG. 5, a towel material strap 2 in accordance with a fourth preferred embodiment of the present invention is disclosed. The top and bottom sides of the units 21 are fixed by the connecting members 22. The two connecting members 22 may be a conventional plastic film, and may be bonded with each other by adhesive. As shown in the figure, the connecting members 22 encompassing the periphery of the units 21 have different lengths, wherein the connecting member 22 having a smaller length has a detachable line 23 mating with the position of the unit 21, so that when the towel material strap 2 is pulled, the connecting member 22 is broken from the detachable line 23. Thus, the units 21 may fall, and the towel material strap 2 may be placed in the chamber 11 of the housing 1, and may be taken out serially.

Figure 6:
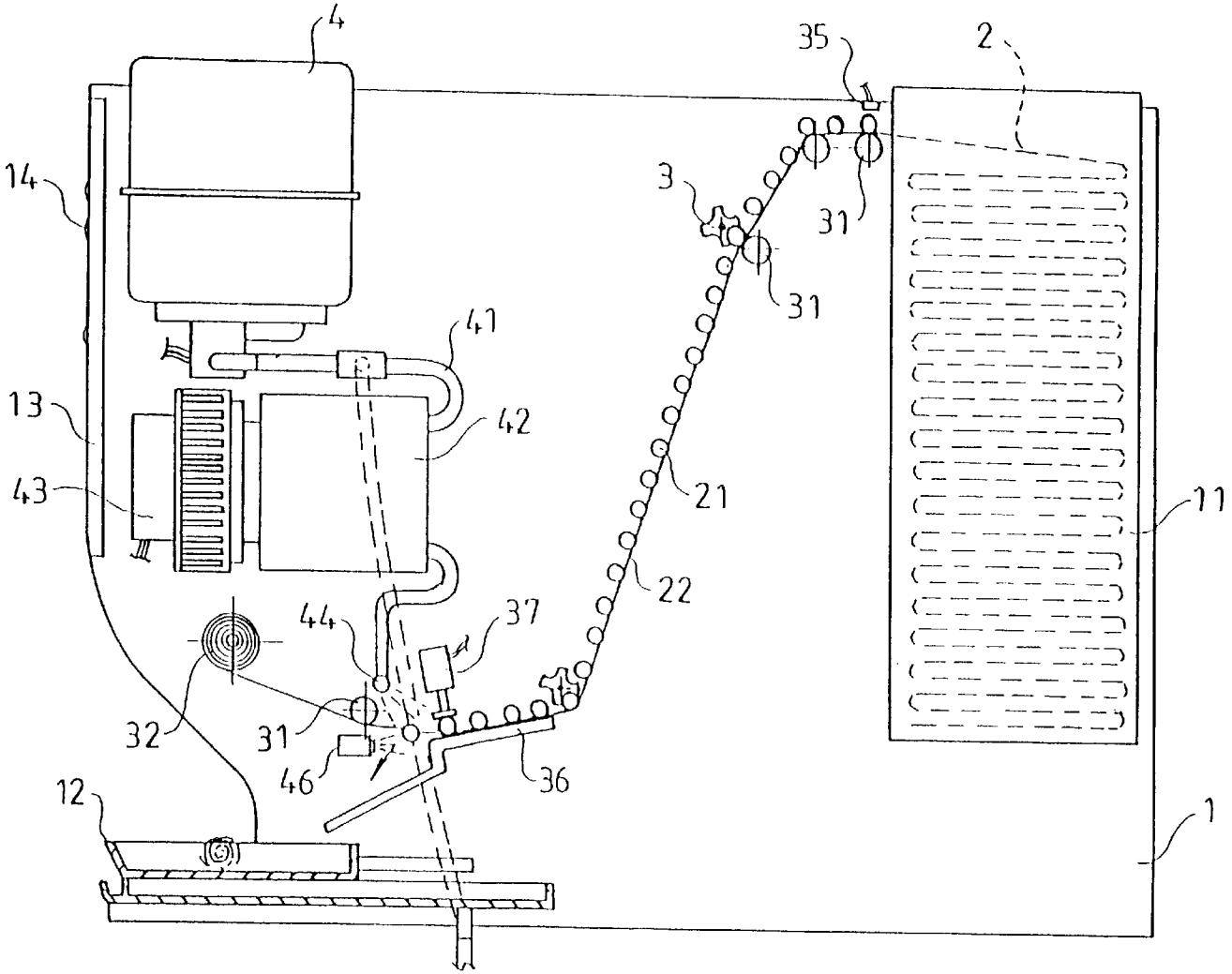
FIG. 6 is a schematic view of a dispensing apparatus of a wet towel in accordance with a second embodiment of the present invention.

Referring now to FIG. 6, the wet towel dispensing apparatus in accordance with a second preferred embodiment of the present invention comprises a housing 1 that may be placed or suspended at a proper position. The housing 1 has a chamber 11 for storing the towel material strap 2, and one end of the towel material strap 2 can be serially taken out from the chamber 11. The housing 1 is provided with a panel 13, and a control member 14, such that the dispensing apparatus of the wet towel may be manipulated, and such that the wet towel can be used from the article outlet 12. In the preferred embodiment, the push buttons of the control member 14 may be pressed to select the amount of the using wet towel, and to select the hot wet towel or cold wet towel.

Figure 7:
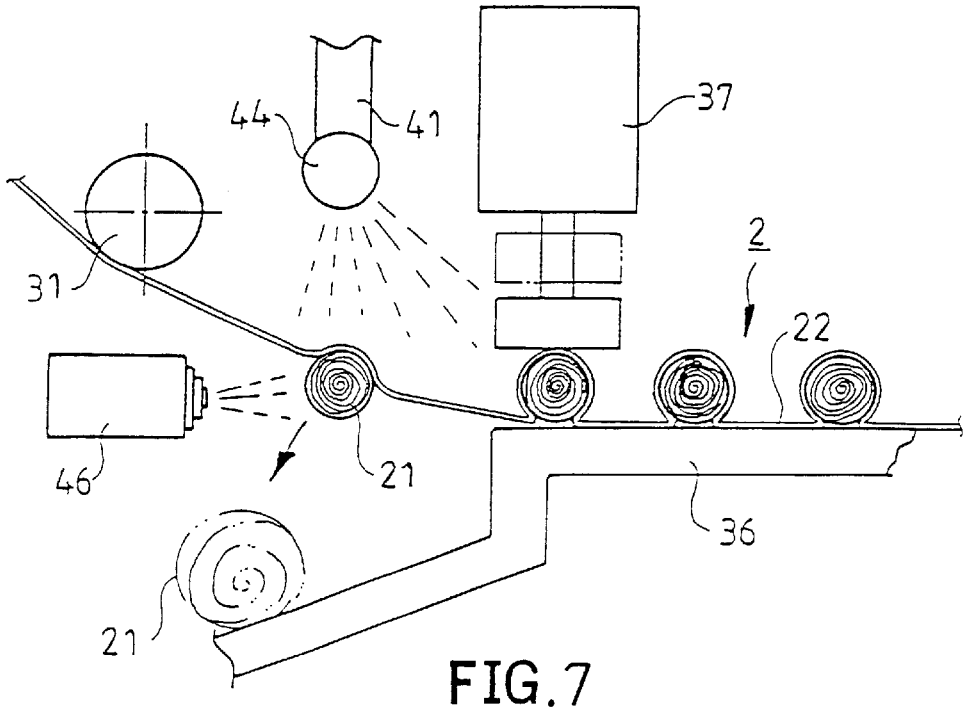
FIG. 7 is an operational view of the dispensing apparatus of a wet towel as shown in FIG. 6 in use.
Figure 8:
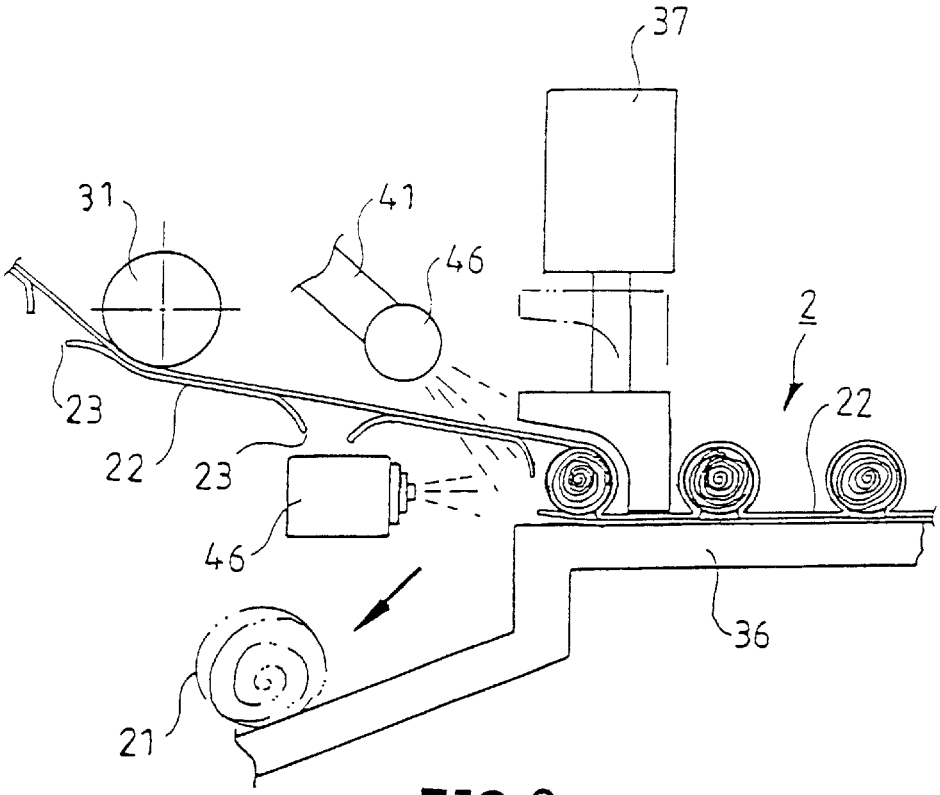
FIG. 8 is an operational view of the dispensing apparatus of a wet towel as shown in FIG. 6 in use.

The control wheel member 3 may be a wheel that can be driven. The user may push the control member 14 to send a using signal, whereby the control wheel member 3 can be driven to rotate by a power member, such as a motor, so that the units 21 of the towel material strap 2 can be serially drawn outward by the control wheel member 3. The towel material strap 2 drawn outward by the control wheel member 3 is controlled by the roll 31, and is conveyed to a support plate 36. The output amount of the units 21 of the towel material strap 2 may be calculated by the sensor 35. When the entire towel material strap 2 is completely released, the sensor 35 may emit a signal, so as to supply the towel material strap 2 into the chamber 11 in time. A press member 37 is mounted above the support plate 36, and can be moved downward when the user pushes the control member 14 to send a using signal, to press one of the units 21 and the connecting member 22 as shown in FIG. 7, or to directly press the connecting member 22 between two units 21 as shown in FIG. 8. At the same time, a winding roller 32 performs the winding action, whereby the connecting member 22 between the winding roller 32 and the press member 37 is stretched, so that the units 21 fall from the connecting member 22 into the article outlet 12 of the housing 1, or the connecting member 22 is broken from the detachable line 23, so that the units 21 fall into the article outlet 12 of the housing 1.

The liquid supply member 4 may be mounted at a proper position of the housing 1, for storing a liquid with a normal temperature. When the user sends the signal of using the hot wet towel or cold wet towel, the liquid may be guided through the guide pipe 41 to the heating member 42 or the cooling member 43, wherein the heating member 42 may be a conventional electrical heater, and the cooling member 43 may be a conventional cooling chip or refrigerant compressor. Thus, the liquid may be formed into the hot water or cold water, and may be ejected through a plurality of nozzles 44, so as to wet the units 21 of the towel material strap 2 between the winding roller 32 and the press member 37, so that the units 21 of the towel material strap 2 are expanded to form the hot wet towel or cold wet towel. In addition, the liquid supply member 4 may be provided with a liquid drain pipe 45. When the liquid stored in the liquid supply member 4 needs to be cleaned or drained, the liquid may directly drained outward through the liquid drain pipe 45. In addition, during the wetting process of the units 21 of the towel material strap 2, the auxiliary nozzle 46 may eject a fragrant agent, so that the hot wet towel or cold wet towel contains fragrance.

Further, the liquid ejected from the nozzle 44 or the auxiliary nozzle 46 may also be directly ejected toward the units 21 placed in the article outlet 12, so that the units 21 may be immersed in the liquid to absorb the liquid.

Referring to FIG. 7, in use of the wet towel dispensing apparatus in accordance with the present invention, the towel material strap 2 is placed in the chamber 11 of the housing 1, so that one end of the towel material strap 2 placed in the chamber 11 of the housing 1 is serially drawn out by the control wheel member 3 and the roll 31 to the support plate 36. The user may push the control member 14 to emit a using signal, whereby the control wheel member 3 may be rotated through a proper angle, so that a predetermined amount of units 21 may be wet by the ejected liquid, while the press member 37 is lowered to press the unit 21 as shown in FIG. 7, or press the connecting member 22 as shown in FIG. 8, as by means of the winding action of the winding roller 32, the units 21 are stripped from the towel material strap 2 to fall into the article outlet 12. At this time, the liquid supply member 4 outputs the liquid which is controlled by the using signal emitted from the user to flow through the operated heating member 42 or cooling member 43, 50 that the liquid becomes hot water or cold water, to wet the units 21 stripped from the towel material strap 2, or to wet or sink the units 21 placed in the article outlet 12. After the unit 21 absorbs the liquid, the unit 21 may be expanded into a wet towel during a short period of time (about three seconds), which may be taken out from the article outlet 12 for use.

Accordingly, the wet towel dispensing method, the wet towel dispensing apparatus, and the towel material unit in accordance with the present invention are completely different from the conventional ones. In accordance with the present invention, the towel material units may be derived from cotton starch, wood starch etc. made of a natural fiber or synthetic fiber, and may be made to have a smaller compact volume by a drying, compressing or evacuating manner. The units are connecting by the connecting member into a continuous strap, such that the units will not be expanded. Thus, the units may constantly maintain a smaller volume, thereby facilitating storage. The towel material strap may be mass produced directly through the factory, thereby greatly decreasing the cost of fabrication. Especially, the wet towel dispensing apparatus does not have the cutting blade set and the twisting set that are most easily worn out, thereby greatly reducing the possibility of failure. In addition, the units in accordance with the present invention derived from cotton starch, wood starch etc. made of a natural fiber or synthetic fiber are made to have a strip shape, block shape, or particle shape with a smaller compact volume by a drying, compressing or evacuating manner, and are then made into a continuous towel material strap. Thus, before the units absorb the liquid, they have a smaller volume and occupy a smaller space, thereby facilitating the storage. Further, when the units are used as wet towel, they may absorb the liquid to be expanded instantaneously, thereby forming the wet towel.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A dispensing apparatus of a wet towel, comprising:

a housing, having a chamber and an object outlet, and provided with a control member;

a towel material strap, having units connected by connecting members into a continuous strap, placed in the chamber of the housing;

a control wheel member, serially drawing out the units of the towel material strap;

a winding roller for winding the connecting members, stripped units falling into an output member;

a liquid supply member, for ejecting liquid from a nozzle, so that the units placed in the output member may absorb the liquid to form a wet towel;

an output member, for supplying the wet towel through an article outlet of the housing.

2. A dispensing apparatus of a wet towel, comprising:

a housing, having a chamber and an object outlet, and provided with a control member;

a towel material strap, having units connected by connecting members into a continuous strap, placed in the chamber of the housing;

a control wheel member, serially drawing out the units of the towel material strap onto a support plate, a press member mounted adjacent the support plate to move downwardly to press one unit of the towel material strap or press the connecting member;

a winding roller for winding the connecting members, so that the units between the press member and the winding wheel are stripped from the towel material strap, and the stripped units fall into the article output of the housing;

a liquid supply member, for ejecting liquid from a nozzle by a guide pipe, so that the units placed in the article outlet or stripped from the towel material strap may absorb the liquid to form a wet towel.

3. The dispensing apparatus of a wet towel as claimed in claim 1 or 2, wherein the liquid from the liquid supply member is introduced through a heating member, so that the ejected liquid forms hot water.

4. The dispensing apparatus of a wet towel as claimed in claim 1 or 2, wherein the liquid from the liquid supply member is introduced through a cooling member, so that the ejected liquid forms cold water.

5. The dispensing apparatus of a wet towel as claimed in claim 1 or 2, further comprising an auxiliary nozzle for adding other liquid.

6. The dispensing apparatus of a wet towel as claimed in claim 1 or 2, further comprising a sensor that transmits a signal for supplying the towel material strap when a terminal unit of the towel material strap passes through the sensor.

* * * * *